United States Patent [19]

Kaya

[11] Patent Number: 4,629,180

[45] Date of Patent: Dec. 16, 1986

[54] EXERCISE DEVICE

[76] Inventor: Feyyaz Kaya, 17 James Street, Aylmer, Quebec, Canada, J9H 4S7

[21] Appl. No.: 738,388

[22] Filed: May 28, 1985

[51] Int. Cl.[4] ..... A63B 71/12

[52] U.S. Cl. ..... 272/93; 272/144; 272/145

[58] Field of Search ..... 272/93, 144–146, 272/72; 128/70, 71, 25 R

[56] References Cited

U.S. PATENT DOCUMENTS

| | | | |
|---|---|---|---|
| 1,143,981 | 6/1915 | Macklin | 128/70 |
| 1,905,092 | 4/1933 | Hardy | 272/72 |
| 2,240,679 | 5/1941 | Stauffer | 128/70 |
| 2,733,922 | 2/1956 | Diego | 272/145 X |
| 2,759,730 | 8/1956 | Berry | 272/145 |
| 3,286,708 | 11/1966 | Gärtner | 272/145 X |
| 3,450,132 | 6/1969 | Ragon et al. | 128/25 R |
| 4,212,458 | 7/1980 | Bizilia | 272/93 |
| 4,241,915 | 12/1980 | Noble et al. | 272/145 |
| 4,534,554 | 8/1985 | Miller | 272/144 |

*Primary Examiner*—Robert A. Hafer
*Assistant Examiner*—Kathleen D'Arrigo
*Attorney, Agent, or Firm*—George A. Seaby

[57] ABSTRACT

The conventional exercise device for performing sit-ups includes a base and a strap for holding the feet of the user on the base. The number of consecutive sit-ups performed by an exerciser can be dramatically increased by using an exercise device including a frame, and footrests, calf supports, thigh supports and a seat on the frame, with each of such elements being adjustable in terms of position and inclination on the frame.

2 Claims, 2 Drawing Figures

EXERCISE DEVICE

BACKGROUND OF THE INVENTION

1. FIELD OF THE INVENTION

This invention relates to an exercise device, and in particular to a device for performing so-called sit-ups.

2. DISCUSSION OF THE PRIOR ART

The type of exercise commonly referred to as the sit-up involves all of the muscles of the legs, and at least some of the muscles of the chest, back and abdomen. From this point of view, sit-ups are an excellent form of exercise. However, unless the person performing the exercise is in fairly good physical condition, few sit-ups can be performed at one time. A review of the Canadian and U.S. patent literature fails to provide a solution to the problem. U.S. Pat. No. 4,198,044, issued to V.A. Hollappa on Apr. 15, 1980 describes an exercise board which could be used to perform sit-ups. However, the Holappa board possesses the disadvantage of conventional exercise apparatuses in that it merely provides straps for anchoring one or more portions of the body while exercising other parts of the body.

The object of the present invention is to overcome the above-mentioned disadvantage by providing a relatively simple exercise device, which facilitates and encourages the performance of sit-ups.

GENERAL DESCRIPTION OF THE INVENTION

Accordingly, the present invention relates to an exercise device comprising frame means; footrest means for receiving and securing the feet of a user; adjustable calf support means for supporting at least one calf of an exerciser; and adjustable thigh support means for supporting at least one thigh of an exerciser, whereby, when performing sit-ups, the exerciser can exercise selected muscles depending upon the particular portion of the legs being supported by said support means.

BRIEF DESCRIPTION OF DRAWINGS

The invention will now be described in greater detail with reference to the accompanying drawing, which illustrates a preferred embodiment of the invention, and wherein.

Figures 1, 2:
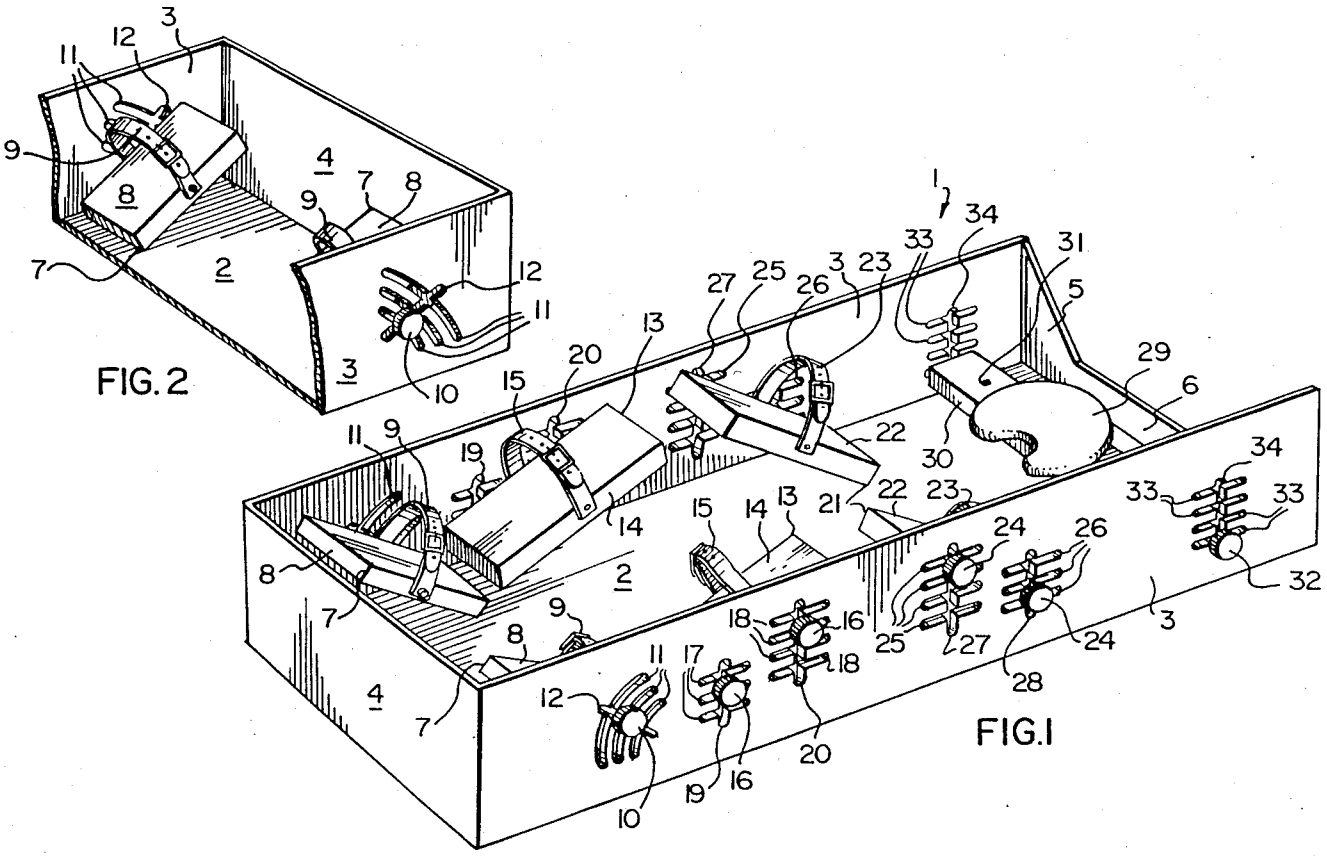
FIG. 1 is a schematic perspective view from above and one end of an exercise device in accordance with the present invention.
FIG. 2 is a perspective view of one end of the device of FIG. 1 taken from above and the end opposite to FIG. 1.

It should be noted that the dimensions and proportions of the elements shown in the drawing are not necessarily accurate, the drawing being for the purposes of illustration only.

DESCRIPTION OF PREFERRED EMBODIMENTS

With reference to the drawing, a preferred embodiment of the exercise device includes a frame, which is defined by a box generally indicated at 1. The box 1 includes a bottom wall 2, side walls 3, a front end wall 4 and a rear end wall 5. The rear wall 5 is generally U-shaped, with a low central area 6 permitting the torso of a user to move between the vertical and horizontal positions without hitting the rear wall. A pair of footrests 7 are mounted in the box 1 near the front wall 4. Each footrest 7 includes a base 8, and a strap 9 for securing the foot of a user to the footrest. A threaded socket (not shown) is provided in the outer side of the base 8 for receiving a bolt on a knob 10. The bolt extends through openings in the side wall 3 of the box 1. The openings include three parallel arcuate slots 11 and a slot 12 inclined in the opposite direction to and intersecting the slots 11. Thus, the footrests 7 can be moved longitudinally and the inclination thereof altered.

A calf support 13 is mounted in the box 1 on each side wall 3 rearwardly of the footrests 7. The calf support 13 is defined by a base 14 and a strap 15 for securing the bottom of the user's leg to the support. Threaded sockets (not shown) are provided in the outer side of the base 14 for receiving bolts. The bolts extend inwardly from knobs 16 through openings in the side wall 3 of the box 1. The openings include parallel horizontal slots 17 and 18 intersected by vertically extending slots 19 and 20, respectively.

A pair of thigh supports 21 are mounted on the side walls 3 of the box 1 rearwardly of the calf supports 13. The supports 21 are similar to the calf supports 13, including bases 22 and straps 23 for retaining the thighs of a user. Threaded sockets (not shown) are provided in the outer sides of the bases 22 for receiving bolts extending inwardly through openings in the sides 3 from knobs 24. The openings include parallel horizontal slots 25 and 26, intersected by vertical slots 27 and 28, respectively.

A seat 29, which is similar in structure to a tractor seat (the drawing shows a conventional seat for the purpose of illustration only), is mounted on a crossbar 30 near the rear end wall 5 of the box 1. A post (not shown) extends downwardly from the bottom of the seat 29 into one of a plurality of sockets 31 (one shown) in the crossbar 30. The row of sockets 31 extends along the central area of the crossbar. The seat 29 is pivotally connected to the post in the same manner as a conventional bicycle seat so that the seat can be rotated around a horizontal axis extending transversely of the box 1. The crossbar 30 is secured in one position by bolts extending inwardly from knobs 32 (one shown through openings in sides 3 into threaded sockets (not shown) in the ends of the crossbar 30. Each of the openings includes parallel horizontal slots 33 intersected by a vertical slot 34, so that the crossbar 30 can be moved vertically and longitudinally to adjust the position of the seat 29.

By placing washers on other spacers on the bolts between the side walls 3 and the bases 8, 14 and 22, the lateral positions of the footrests 7, the calf supports 13 and the thigh supports 21 in the box 1 can be adjusted.

In use, the exerciser sits on seat 29 and secures his or her feet on the footrests 7 by means of the straps 9. The calf and thigh supports 13 and 21 are absent, and the device is used for conventional sit-ups. At least one of the calf supports 13 and/or thigh supports 21 is added to the box 1 and adjusted to the leg(s) of the exerciser. The leg(s) is secured to the support(s) and the sit-ups are continued. Another support(s) is added, and the sit-ups are continued. It will be appreciated that many muscles are involved in the ordinary sit-up. It has been found that by supporting the various portions of one or both of the legs, some of the muscles only are used while other muscles are rested. By continuing to make adjustments to the supports 13 and 21, the number of consecutive sit-ups which an individual can perform is dramatically increased. Thus, the user is encouraged to continue exercising.

It will be appreciated that in its simplest form, the device can include a simple frame (i.e. not a box), footrests connected to the frame, and adjustable calf and thigh supports. In this case, "adjustable" is intended to means movable and pivotable for adjusting the position and inclination of the supports to the legs of the user.

I claim:

1. An exercise device comprising frame means; first and second footrest means mounted on said frame means for independent rotational and longitudinal adjustment on said frame means; first and second calf support means mounted on said frame means for independent rotational and longitudinal adjustment on said frame means; and first and second thigh support means mounted on said frame means for independent rotational and longitudinal adjustment on said frame means, whereby sit-ups can be performed with at least one foot, at least one calf or at least one thigh supported, so that an exerciser can exercise selected muscles depending on the portion of the anatomy being supported.

2. An exercise device according to claim 1, including seat means mounted on said frame means rearwardly of said thigh support means for rotational and longitudinal adjustment on said frame means.

* * * * *